US007711306B2

(12) United States Patent
Kagawa

(10) Patent No.: US 7,711,306 B2
(45) Date of Patent: May 4, 2010

(54) EXTERNALLY HEATED FIXING APPARATUS WITH ENDLESS BELT AND IMAGE FORMING APPARATUS INCLUDING THE SAME

(75) Inventor: Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 582 days.

(21) Appl. No.: 11/626,980

(22) Filed: Jan. 25, 2007

(65) Prior Publication Data

US 2007/0189817 A1 Aug. 16, 2007

(30) Foreign Application Priority Data

Feb. 10, 2006 (JP) ..... 2006-034454

(51) Int. Cl.
*G03G 15/20* (2006.01)

(52) U.S. Cl. ..... 399/330

(58) Field of Classification Search ..... 399/328, 399/330, 335, 338; 219/216
See application file for complete search history.

(56) References Cited

U.S. PATENT DOCUMENTS

| | | | | |
|---|---|---|---|---|
| 3,637,976 | A * | 1/1972 | Ohta et al. | 219/216 |
| 6,246,858 | B1 * | 6/2001 | Condello et al. | 399/329 |
| 6,650,863 | B2 * | 11/2003 | Fuma | 399/329 |
| 7,010,255 | B2 * | 3/2006 | Yura et al. | 399/328 |
| 7,194,233 | B2 * | 3/2007 | Wu et al. | 399/328 |
| 7,454,161 | B2 * | 11/2008 | Watanabe et al. | 399/329 |
| 2005/0117942 | A1 | 6/2005 | Ishii et al. | |
| 2005/0214043 | A1 | 9/2005 | Kameda | |
| 2005/0226660 | A1 * | 10/2005 | Fuma | 399/328 |
| 2007/0212093 | A1 * | 9/2007 | Maeda et al. | 399/69 |
| 2007/0217838 | A1 * | 9/2007 | Yamana et al. | 399/328 |

FOREIGN PATENT DOCUMENTS

| | | | |
|---|---|---|---|
| JP | 52-017031 | | 2/1977 |
| JP | 60159874 | A * | 8/1985 |
| JP | 2002229374 | A * | 8/2002 |
| JP | 2003015445 | A * | 1/2003 |
| JP | 2004-198659 | | 7/2004 |
| JP | 2004239956 | A * | 8/2004 |
| JP | 2005-164691 | | 6/2005 |
| JP | 2005-189427 | | 7/2005 |
| JP | 2005-258130 | | 9/2005 |
| JP | 2005-292714 | | 10/2005 |
| JP | 2005-300800 | | 10/2005 |

OTHER PUBLICATIONS

European Search Report for corresponding European Application No. 07 00 2629.9 dated Apr. 23, 2007.

* cited by examiner

*Primary Examiner*—Robert Beatty
(74) *Attorney, Agent, or Firm*—Renner, Otto, Boisselle & Sklar, LLP

(57) ABSTRACT

A center distance between heating rollers for suspending an external heating belt is fixed, and a peripheral length of the external heating belt is set so that a tension is not exerted to the external heating belt when the external heating belt is not pressed against the fixing roller and the tension is exerted to the external heating belt when the external heating belt is pressed against the fixing roller. As a result, it is possible to provide an external belt heating type fixing apparatus, having a simple arrangement, which is excellent in a thermal efficiency and can suppress snaking of the belt.

9 Claims, 6 Drawing Sheets

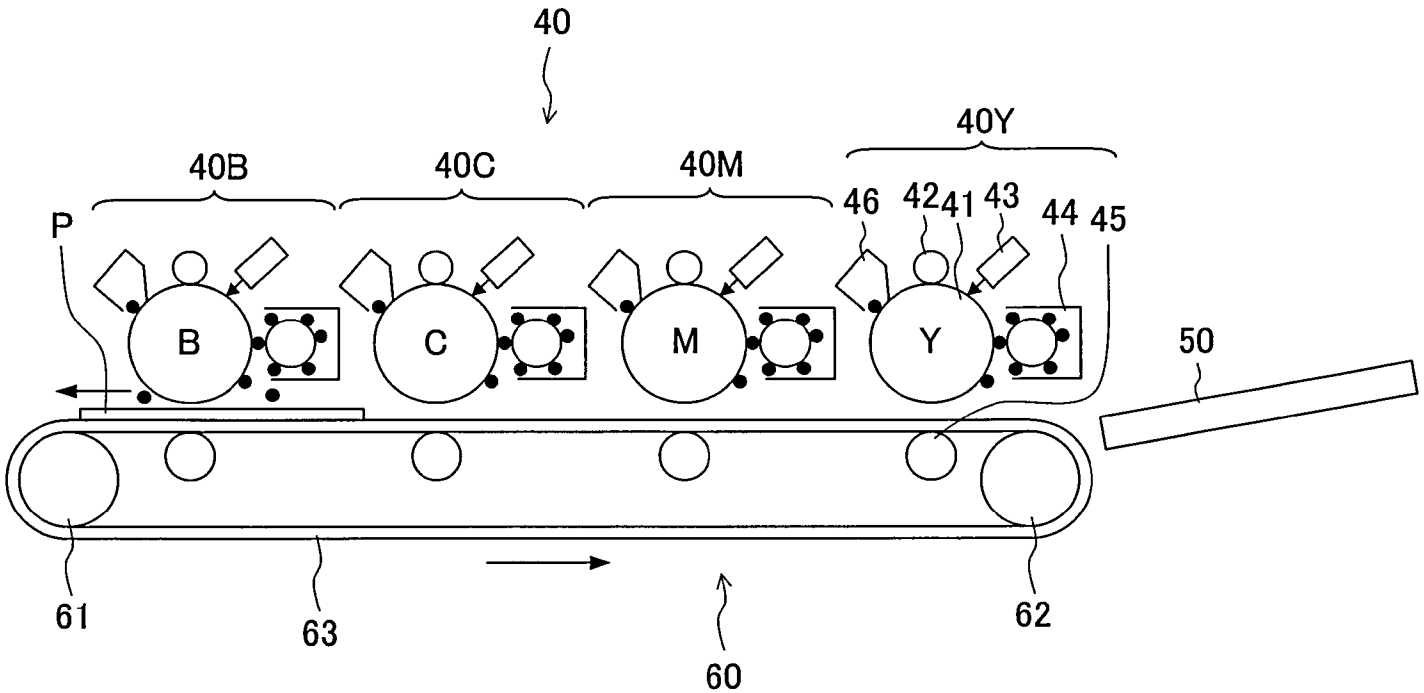
FIG. 7
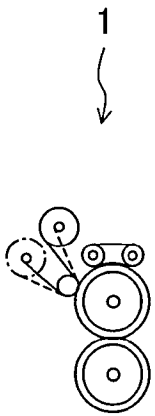

EXTERNALLY HEATED FIXING APPARATUS WITH ENDLESS BELT AND IMAGE FORMING APPARATUS INCLUDING THE SAME

This Nonprovisional application claims priority under 35 U.S.C. §119(a) on Patent Application No. 34454/2006 filed in Japan on Feb. 10, 2006, the entire contents of which are hereby incorporated by reference.

FIELD OF THE INVENTION

The present invention relates to (i) an external belt heating type fixing apparatus used in an electrophotographic image forming apparatus and (ii) an image forming apparatus having the fixing apparatus.

BACKGROUND OF THE INVENTION

As a fixing apparatus used in an electrophotographic image forming apparatus such as a copying machine, a printer, and the like, a heat roller type fixing apparatus is frequently used. The heat roller type fixing apparatus includes a pair of rollers (a fixing roller and a pressing roller) which are pressed against each other, wherein heating means constituted of halogen heaters disposed in both the rollers or a halogen heater disposed in one of the rollers heats the pair of rollers at a predetermined temperature (fixing temperature), and a recording paper on which an unfixed toner image is formed is fed to a pressing section (fixing nip section) of the pair of rollers, and the recording paper is allowed to pass through the pressing section so as to fix the toner image by heat and pressure.

In a fixing apparatus provided in a color image forming apparatus, it is general to use an elastic roller having an elastic layer which is made of silicon rubber or the like and which is provided on a fixing roller surface layer. The elastic roller is used as the fixing roller, so that the fixing roller surface is elastically deformed corresponding to an uneven surface of the unfixed toner image and is in contact with the toner image so as to cover the toner image. This allows the color unfixed toner image whose toner amount is larger than that of monochrome to be favorably heated and fixed. Further, due to strain release of the elastic layer which occurs in the fixing nip section, it is possible to improve a releasing property with respect to color toner which is more likely to offset than monochrome toner. Further, a nip shape of the fixing nip section has a concave upward (on the side of the fixing roller) (that is, the nip shape is a so-called inverse nip shape), so that it is possible to more favorably strip paper. As a result, it is possible to strip paper without using any stripping means such as a stripping protrusion (self stripping), so that it is possible to prevent insufficient image formation which is caused by the stripping means.

However, in the fixing roller having the elastic layer, the elastic layer cannot sufficiently conducts heat. Thus, in case where the heating means is provided in the fixing roller, heat is less efficiently conducted, so that it takes longer time to warm up. In case where the process is carried out at higher speed, the fixing roller cannot follow the process.

As a method for solving these problems, a technique in which external heating means is brought into contact with the fixing roller surface so that the fixing roller is heated from the outside (external heat fixing process) is known. For example, each of below-described Patent Documents 1 and 2 proposes an external belt heat fixing process using an endless belt as external heating means.

Note that, in a conventional external belt heat fixing type fixing apparatus, a plurality of rollers (belt suspending rollers) each of which suspends an endless belt are used as tension rollers each of which exerts a tension to the endless belt or it may be so arranged that a tension roller for the endless belt is provided to exert a tension to the endless belt (see Patent Documents 1 and 2).

(Patent Document 1)

Japanese Unexamined Patent Publication No. 198659/2004 (Tokukai 2004-198659) (Publication date: Jul. 15, 2004)

(Patent Document 2)

Japanese Unexamined Patent Publication No. 189427/2005 (Tokukai 2005-189427) (Publication date: Jul. 14, 2005)

However, in case where one of the belt suspending rollers is used as a tension roller, this requires a complicate mechanism for exerting a tension to the endless belt. Further, it is impossible to keep the plural belt suspending rollers in parallel to each other, so that the endless belt has a greater deviation force (force which causes the endless belt to move in a direction perpendicular to a rotational direction). As a result, it is difficult to control snaking of the belt.

Further, in case where a tension roller is additionally provided on the outside of the endless belt, the number of parts required therein becomes increase, so that the arrangement is complicated. Further, there is such a problem that: the tension roller becomes a thermal load, so that the thermal efficiency drops.

SUMMARY OF THE INVENTION

In view of the foregoing problems, the present invention was devised. An object of the present invention is to provide (i) an external belt heat type fixing apparatus, having a simple arrangement, which is excellent in a thermal efficiency and suppresses snaking of the belt and (ii) an image forming apparatus having the fixing apparatus.

In order to solve the foregoing problems, a fixing apparatus of the present invention includes: a fixing member; an endless belt; a plurality of suspending rollers for suspending the endless belt; and heating means for heating the endless belt, the endless belt being pressed against the fixing member so as to heat the fixing member, wherein the suspending rollers are provided in parallel so that a center distance therebetween is fixed, and the endless belt is pressed against the fixing member so as to be rotated by the fixing member, and an internal peripheral length of the endless belt is set so that a tension is not exerted to the endless belt when the endless belt is not pressed against the fixing member and the tension is exerted to the endless belt when the endless belt is pressed against the fixing member. Note that, the internal peripheral length which does not cause the tension to be exerted to the endless belt is theoretically a length which does not cause the tension to be exerted to the endless belt when influence of a weight of the endless belt is not taken into consideration.

According to the arrangement, the suspending rollers are provided in parallel so that the center distance therebetween is fixed, so that it is possible to secure the parallelism between the belt suspending rollers even when the endless belt is rotated by the fixing member. Thus, it is possible to reduce the deviation force exerted to the endless belt, thereby preventing snaking of the endless belt.

Further, the internal peripheral length of the endless belt is set so that the tension is not exerted to the endless belt when the endless belt is not pressed against the fixing member.

Thus, by preventing the tension from being exerted to the endless belt when the endless belt is not pressed against the fixing member, it is possible to improve the workability such as suspension of the endless belt with respect to the suspending rollers.

Further, the internal peripheral length of the endless belt is set so that the tension is exerted to the endless belt when the endless belt is pressed against the fixing member, so that it is not necessary to additionally provide a member (tension roller or the like) for exerting the tension to the endless belt, thereby simplifying the arrangement of the fixing apparatus. Further, it is possible to reduce the thermal load and to improve the thermal efficiency compared with the case where the tension roller or the like is provided.

Further, the center distance between the suspending rollers is fixed, so that the tension exerted to the endless belt is lower in a high temperature state (heating state) than a low temperature state (room temperature state) due to thermal expansion of the endless belt. Thus, it is possible to prevent slip between the endless belt and the suspending rollers at the time of warm-up of the fixing apparatus, and it is possible to prevent abrasion or breakage of the endless belt which is caused by snaking of the endless belt in the heating state.

Further, an image forming apparatus of the present invention includes: image forming means for forming a toner image on a recording material; and the aforementioned fixing apparatus. Thus, the image forming apparatus of the present invention exhibits the same effects as the aforementioned fixing apparatus.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 4(*b*) illustrates an ideal peripheral length of the external heat belt of the fixing apparatus according to one embodiment of the present invention under such condition that the external heat belt is pressed against the fixing roller.

FIG. 5(*a*) illustrates a case where Lb'≦L2, FIG. 5(*b*) illustrates a case where Lb'≧L2, and FIG. 5(*c*) illustrates a case where Lb' is substantially equal with L2.

FIG. 7 is a cross sectional view illustrating an example of a structure of a color image forming apparatus to which the fixing apparatus of the present invention is applied.

DESCRIPTION OF THE EMBODIMENTS

Figure 1:
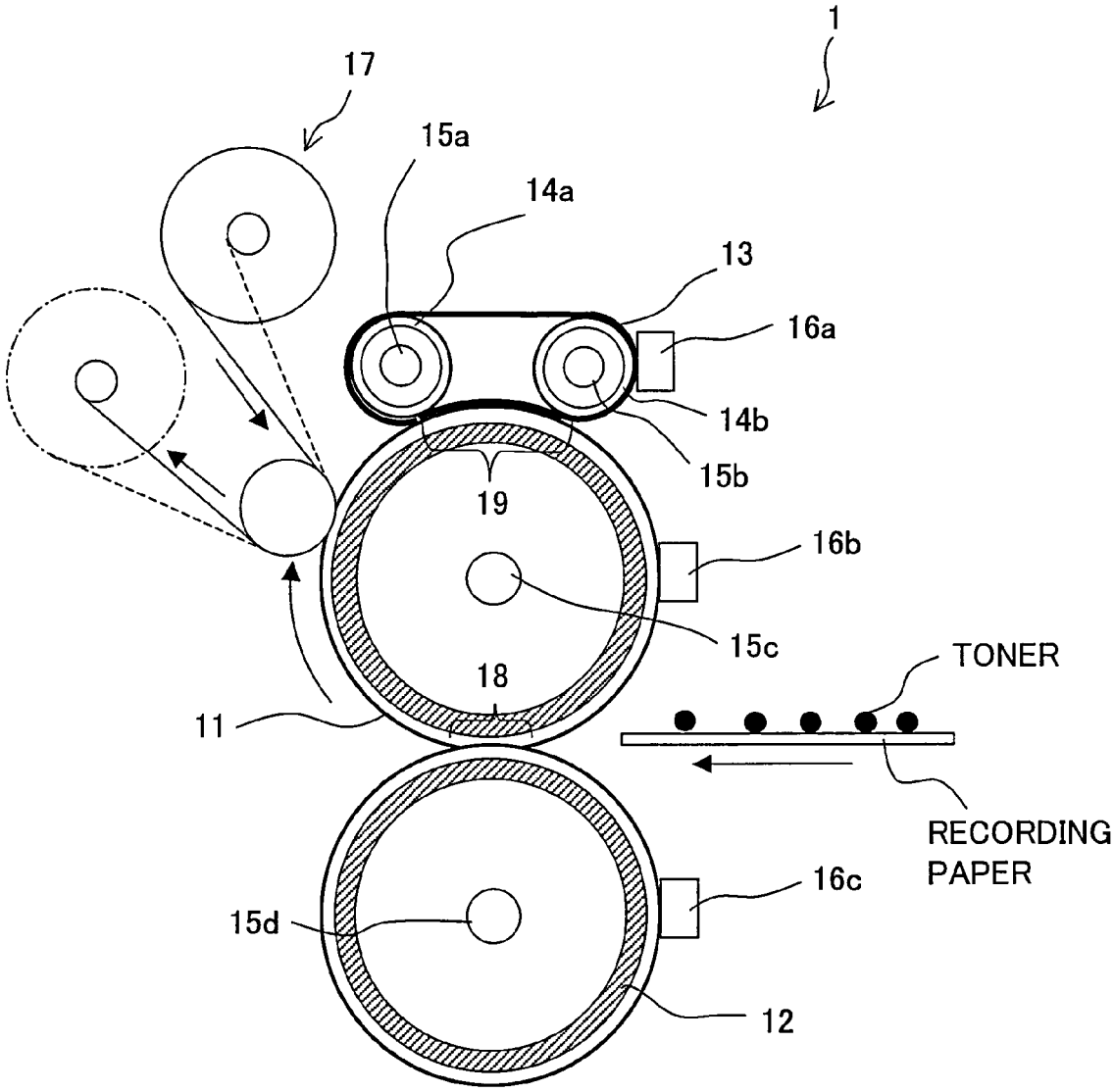
FIG. 1 is a cross sectional view of a fixing apparatus according to one embodiment of the present invention.

One embodiment of the present invention is described as follows. FIG. 7 is a cross sectional view schematically illustrating a color image forming apparatus (image forming apparatus) according to the present embodiment.

As illustrated in FIG. 7, the color image forming apparatus is a so-called tandem type printer in which four-color visible image forming units 40 (40Y, 40M, 40C, and 40B) are disposed along a transport path of a recording paper (heated material). Specifically, the color image forming apparatus includes: a feeding tray 50 for feeding a recording paper P; a fixing apparatus 1; a recording paper transporting means 60 for transporting the recording paper P along a transport path connecting the feeding tray 50 and the fixing apparatus 1; and four visible image forming units 40Y, 40M, 40C, and 40B disposed along the transport path. Further, after the visible image forming units 40Y, 40M, 40C, and 40B carry out multi layer transfer of respective color toners with respect to the recording paper P transported along the transport path by the recording paper transporting means 60, the fixing apparatus 1 fixes each color toner on the recording paper P, thereby forming a full-color image.

The recording paper transporting means 60 includes: a driving roller 61; an idling roller 62; and an endless transport belt 63 suspended by both the rollers 61 and 62. Further, the driving roller 61 is rotationally driven by driving means (not shown), so that the transport belt 63 is rotated along the transport path at a predetermined speed (in the present embodiment, at 355 mm/s), thereby transporting the recording paper P which has been adsorbed to the transport belt 63 in an electrostatic manner.

Each of the visible image forming units 40 includes a charging roller 42, a laser beam emitting means 43, a developing device 44, a transfer roller 45, and a cleaner 46, which are provided around a photosensitive drum 41. Note that, respective developing devices 44 provided in the visible image forming units 40Y, 40M, 40C, and 40B respectively store yellow toner (Y), magenta toner (M), cyan toner (C), and black toner (B). Further, each of the visible image forming units 40 forms a toner image on the recording paper P in accordance with the following steps. That is, after the charging roller 42 evenly charges a surface of the photosensitive drum 41, the laser beam emitting means 43 carries out laser exposure with respect to the surface of the photosensitive drum 41 in accordance with image information, thereby forming an electrostatic latent image. Thereafter, the developing device 44 develops the electrostatic latent image on the photosensitive drum 41 so as to visualize the toner image, and the visualized toner image is sequentially transferred to the recording paper P transported by the recording paper transporting means 60 with use of the transfer roller 45 to which a bias voltage having a polarity opposite to the toner is applied.

Then, after the recording paper P to which the toner image constituted of respective colors has been transferred is stripped from the transport belt 63 due to a curvature of the driving roller 61, the recording paper P is transported to the fixing apparatus 1. Further, the fixing apparatus 1 gives suitable temperature and pressure to the recording paper P. As a result, the toner fuses and is fixed on the recording paper P, so that a rigid image is formed.

Next, a structure of the fixing apparatus 1 is described as follows. FIG. 1 is a cross sectional view illustrating the structure of the fixing apparatus 1. The fixing apparatus 1 fixes an unfixed toner image, formed on a surface of the recording paper (recording material), onto the recording paper due to heat and pressure. Note that, the unfixed toner image is constituted of developer, e.g., nonmagnetic monocomponent developer (nonmagnetic toner), nonmagnetic bicomponent developer (nonmagnetic toner and carrier), magnetic developer (magnetic toner), and the like.

As illustrated in FIG. 1, the fixing apparatus 1 includes: a fixing roller (fixing member) 11, a pressure roller 12; an endless external heating belt (endless belt) 13 serving as an external heating member; heating rollers (suspending rollers) 14*a* and 14*b* for suspending and heating the external heating belt 13; heater lamps (heating means) 15*a* and 15*b* which are heat sources for respectively heating the heating rollers 14*a* and 14*b*; a heater lamp 15*c* which is a heat source for heating the fixing roller 12; thermistors 16*a*, 16*b*, and 16*c* serving as temperature sensors constituting temperature detecting means for detecting temperatures of the external heating belt 13, the fixing roller 11, and the pressure roller 12 respectively; and a web cleaning device 17 for cleaning the fixing roller 11. Note that, the external heating belt 13, the heating rollers 14*a* and 14*b*, and the heater lamps 15*a* and 15*b* are provided on a below-described external heating belt unit 30.

The fixing roller 11 and the pressure roller 12 are pressed against each other with a predetermined load (for example, 600N in the present embodiment) so that a fixing nip section 18 (a portion in which the fixing roller 11 and the pressure roller 12 are in contact with each other) is formed between both the rollers. Note that, in the present embodiment, a nip width (a width of the fixing nip section 18 in a recording paper transporting direction) is 9 mm. The recording paper having an unfixed toner image is fed at the fixing nip 18 and is allowed to pass through the nip section 18, thereby fixing the toner image on the recording paper. At the time when the recording paper passes through the nip section 18, the fixing roller 11 comes into contact with a toner image formation surface of the recording paper, and the pressure roller 12 comes into contact with a surface of the recording paper which surface is opposite to the toner image formation surface.

The fixing roller 11 is heated at a predetermined temperature (180° C. in the present embodiment) so as to heat the recording paper which passes through the fixing nip section 18 and has the unfixed toner image. The fixing roller 11 has a three-layer structure in which a core bar, an elastic layer, and a releasing layer are provided from the center toward the outside. Examples of the core bar include: metal such as iron, stainless steel, aluminum, copper, and the like; alloy thereof; or the like. Further, a suitable material constituting the elastic layer is silicon rubber, and examples of a suitable material constituting the releasing layer include fluorocarbon resin such as PFA (copolymer of tetrafluoroethylene and perfluoroalkylvinylether), PTEF (polytetrafluoroethylene), and the like.

Note that, in the fixing roller 11, the heater lamp 15*c* for heating the fixing roller 11 is disposed. A control circuit (not shown) causes a power source circuit (not shown) to supply power to the heater lamp 15*c* (the control circuit causes the power source circuit to make the heater lamp 15*c* conductive), so that the heater lamp 15*c* emits light. As a result, the heater lamp 15*c* irradiates an infrared lay. Thus, an internal peripheral face of the fixing roller 11 absorbs the infrared ray, so that the internal peripheral face is heated. As a result, the fixing roller 11 is entirely heated.

As in the fixing roller 11, also the pressure roller 12 includes an elastic layer, such as silicon rubber, which is provided on an external peripheral face made of iron, stainless steel, aluminum, and the like, and a releasing layer made of PFA or the like is provided thereon. Further, in the pressure roller 12, the heater lamp 15*d* for heating the pressure roller 12 is disposed. As in the fixing roller 11, the pressure roller 12 is entirely heated by the heater lamp 15*d*.

The external heating belt 13 comes in contact with a surface of the fixing roller 11 with the external heating belt 13 heated at a predetermined temperature (220° C. in the present embodiment) so as to heat the surface of the fixing roller 11. The external heating belt 13 is suspended by the two heating rollers 14*a* and 14*b*. Further, in the heating rollers 14*a* and 14*b*, the heater lamps 15*a* and 15*b* for heating the heating rollers 14*a* and 14*b* are respectively disposed. A control circuit (not shown) causes a power source circuit (not shown) to supply power to the heater lamps 15*a* and 15*b*, so that the heater lamps 15*a* and 15*b* irradiate infrared rays. As a result, internal peripheral faces of the heating rollers 14*a* and 14*b* are heated, so that the external heating belt 13 is indirectly heated via the heating rollers 14*a* and 14*b*.

The external heating belt 13 is provided on an upstream side with respect to the fixing nip section 18 in a rotational direction of the fixing roller 11 and is pressed against the fixing roller at a predetermined pressure (40N in the present embodiment). Note that, a mechanism (structure of the external heating belt unit 30) for pressing the external heating belt 13 against the fixing roller 11 will be described below. Further, a heating nip section 19 (a portion in which the fixing roller 19 and the external heating belt 13 are in contact with each other) is formed between the fixing roller 11 and the external heating belt 13. The external heating belt 13 is rotated by the fixing roller 11 at the time of rotation of the fixing roller 11, and the rotation of the external heating belt 13 causes the heating rollers 14*a* and 14*b* to rotate. Note that, a heating nip width (width of the heating nip section 19 in a rotational direction of the fixing roller 11) of the heating nip section 19 is set so that the external heating belt 13 suitably heats the fixing roller 11 and the external heating belt 13 is suitably rotated by the fixing roller 11. In the present embodiment, the heating nip width is 20 mm.

The external heating belt 13 has a two-layer structure in which a releasing layer made of synthetic resin material (fluorocarbon resin such as PFA, PTEF, and the like for example) having excellent heat resistance and excellent releasing property is formed on a surface of a heat resistant resin such as polyimide. Note that, in order to reduce a deviation force (force which causes the external heating belt 13 to move in a direction perpendicular to the rotational direction) of the external heating belt 13, an internal face of the belt base material may be coated with fluorocarbon resin or the like.

Each of the heating rollers 14*a* and 14*b* is constituted of a hollow cylindrical metal core material made of aluminum or iron and the like. Note that, in order to reduce the deviation force of the external heating belt 13, a surface of the metal core material may be coated with a fluorocarbon resin or the like.

The thermistor 16*b* serving as temperature detecting means is provided on a peripheral face of the fixing roller 11. The thermistor 16*c* serving as temperature detecting means is provided on a peripheral face of the pressure roller 12. The thermistor 16*a* serving as temperature detecting means is provided on a peripheral face of the external heating belt 13. Each thermistor detects each surface temperature. Further, in accordance with temperature data obtained by the thermistors 16*a*, 16*b*, and 16*c*, a control circuit (not shown) serving as temperature controlling means controls power supplied to the heater lamps 15*a*, 15*b*, 15*c*, and 15*d* (the control circuit controls conduction of the heater lamps 15*a*, 15*b*, 15*c*, and 15*d*) so that the fixing roller 11, the heating roller 12, and the external heating belt 13 respectively have predetermined temperatures.

Further, the recording paper on which the unfixed toner image has been formed at a predetermined fixing speed and a predetermined copying speed is transported to the fixing nip section 18, and the unfixed toner image is fixed by heat and pressure. Note that, the fixing speed is a so-called process speed. Further, the copying speed means the number of sheets copied per one minute. These speeds are not particularly limited. However, in the present embodiment, the fixing speed is 355 mm/sec, and the copying speed is 70 sheets/minute.

Note that, the fixing roller 11 is rotated by a driving motor (driving means: not shown). Further, the rotation of the fixing roller 11 causes the pressure roller 12 to rotate. Thus, as illustrated in FIG. 1, a direction in which the fixing roller 11 is rotated and a direction in which the pressure roller 12 is rotated are opposite to each other. As a result, the recording paper P passes through the fixing nip section 18.

Figure 2:
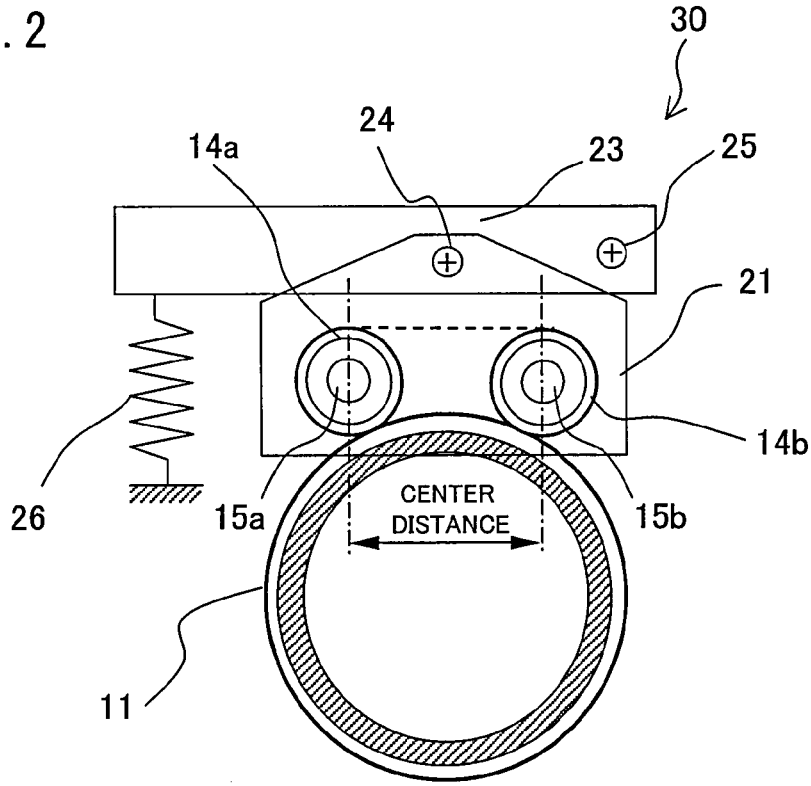
FIG. 2 is a cross sectional view of an external heat belt unit of the fixing apparatus according to one embodiment of the present invention.
Figure 3:
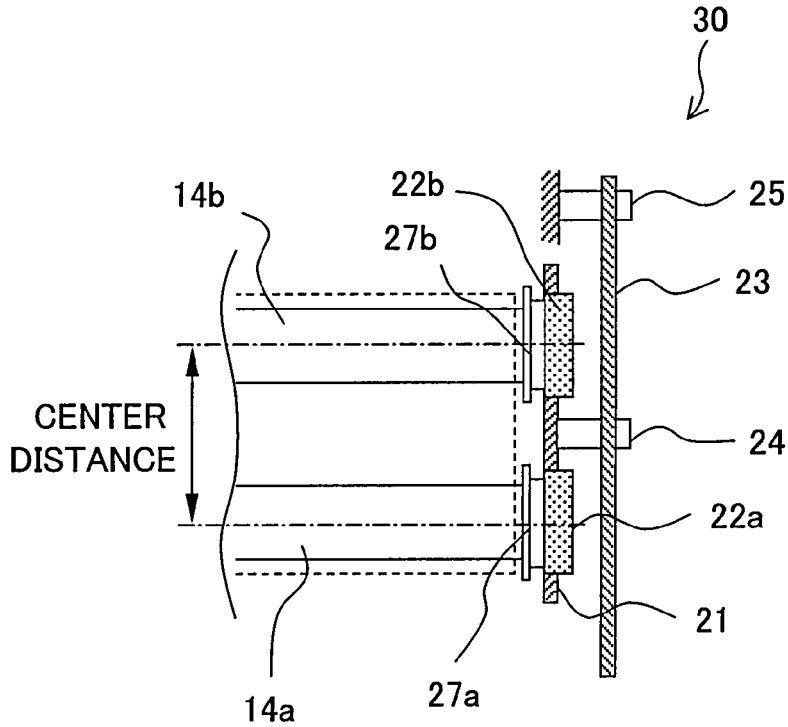
FIG. 3 is a top view of the external heat belt unit of the fixing apparatus according to one embodiment of the present invention.

Next, with reference to FIG. 2 and FIG. 3, a structure of the external heating belt unit 30 is detailed. FIG. 2 is a cross sectional view illustrating the structure of the external heating belt unit 30, and FIG. 3 is a top view thereof.

As illustrated in FIG. 2 and FIG. 3, there are provided the external heating belt 13, the heating rollers 14*a* and 14*b*, the heater lamps 15*a* and 15*b*, a side frame 21, bearings 22*a* and 22*b*, an arm 23, fulcrums 24 and 25, a coil spring 26, deviation preventing members 27*a* and 27*b*, and the like.

The heating rollers 14*a* and 14*b* for suspending the external heating belt 13 are rotatably supported respectively by the bearings 22*a* and 22*b* that are provided on the side frame 21. Note that, FIG. 3 illustrates only one end side of the heating rollers 14*a* and 14*b*, but the other end side are arranged substantially in the same manner. Further, the bearings 22*a* and 22*b* are fixed on the side frame with a predetermined center distance therebetween. As a result, the heating rollers 14*a* and 14*b* are kept in parallel to each other. In the present embodiment, a common difference in the parallelism between the heating rollers 14*a* and 14*b* is not more than 100 μm.

Further, the side frame 21 is axially supported by the arm 23 so as to be rotatable around the fulcrum 24. Further, the arm 23 is axially supported so as to be rotatable around the fulcrum 25. Further, the coil spring 26 is provided on the arm 23 so as to be positioned in an end opposite to the fulcrum 25, and the coil spring 26 gives a load to the end of the arm 23. This causes the side frame 21 provided on the arm 23 to be pushed toward the fixing roller 11. As a result, the heating rollers 14*a* and 14*b* axially supported by the side frame 21 are pressed against the fixing roller 11 via the external heating belt 13 with equal loads.

Further, the deviation preventing members 27*a* and 27*b* for preventing the external heating belt 13 from snaking are provided on the heating rollers 14*a* and 14*b* so as to be positioned respectively on the end side of the heating roller 14*a* and on the end side of the heating roller 14*b* (so as to be positioned more internally than the bearing 22*a* and the bearing 22*b* respectively). The deviation preventing members 27*a* and 27*b* are rotated in combination with a side portion of the external heating belt 13. As a result, it is possible to restrict deviation of the snaking external heating belt 13 and it is possible to prevent the side portion of the external heating belt 13 from being abraded or torn due to sliding of the external heating belt 13.

Figure 4A:
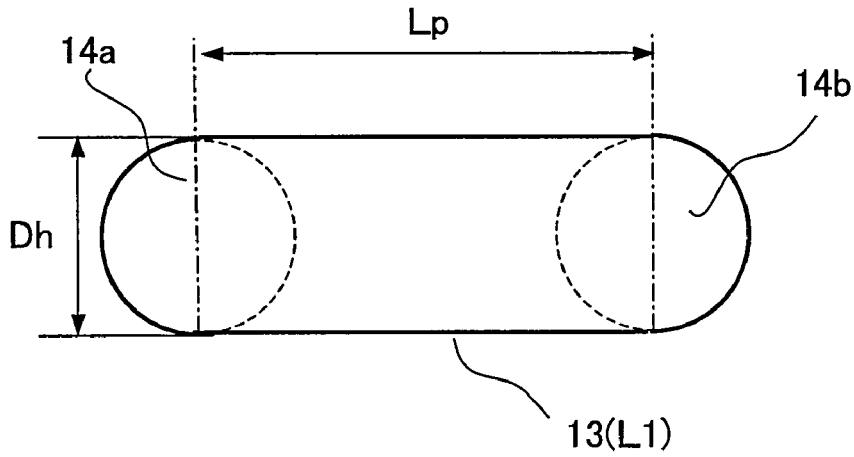
FIG. 4(*a*) illustrates an ideal peripheral length of the external heat belt of the fixing apparatus according to one embodiment of the present invention under such condition that the external heat belt is not pressed against a fixing roller.
Figure 4B:
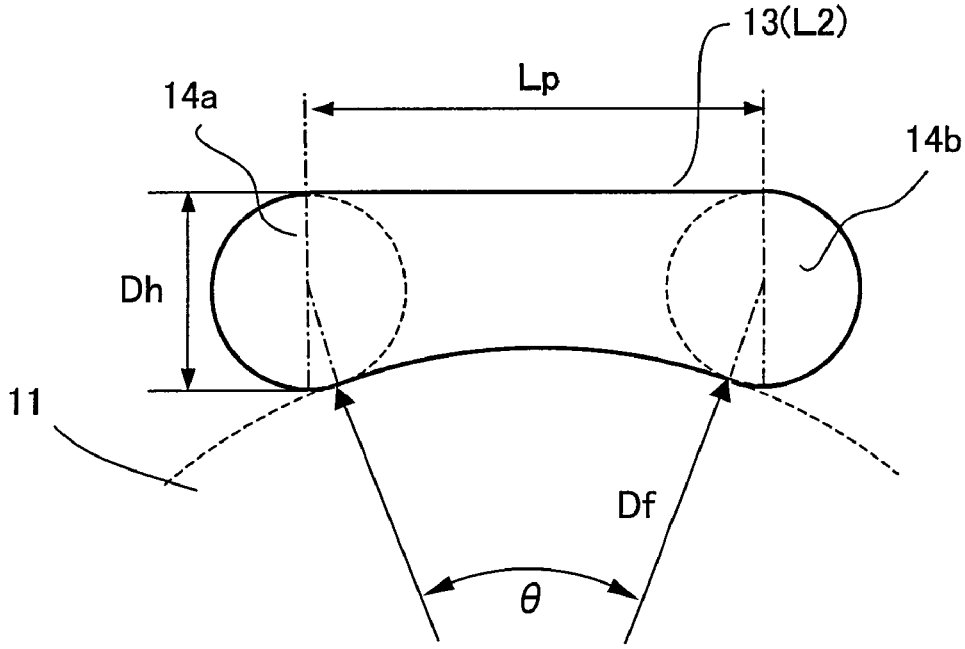

Next, a peripheral length (internal peripheral length) of the external heating belt 13 will be detailed. FIG. 4(*a*) illustrates an ideal peripheral length L1 of the external heating belt 13 without being pressed by the fixing roller 11. Further, FIG. 4(*b*) illustrates an ideal peripheral length L2 of the external heating belt 13 with the external heating belt 13 pressed by the fixing roller 11.

Note that, the ideal peripheral length L1 is an internal peripheral length (a peripheral length of a face which is in contact with the heating rollers 14*a* and 14*b*) which is set so that the external heating belt 13 does not loosen (sag) and is free from any tension under such condition that the external heating belt 13 is pressed against the fixing roller 11.

As described above, the external heating belt 13 is suspended by the two heating rollers 14*a* and 14*b* whose center distance is fixed. Thus, as apparent from FIG. 4(*a*), the ideal peripheral length L1 is represented as follows.

$$L1=\pi\times Dh+2\times Lp$$

where Dh represents an external diameter of each of the heating rollers 14*a* and 14*b*, and Lp represents a center distance between the heating rollers 14*a* and 14*b*.

Thus, by setting Lb so that the following expression is satisfied $$L1\leqq Lb \quad (1)$$

where Lb represents an internal peripheral length (a peripheral length at a room temperature (for example, 20° C.)) of the external heating belt 13, it is possible to realize the condition under which: in case where the external heating belt 13 is not pressed against the fixing roller 11, no tension is exerted to the external heating belt 13 (on the assumption that a tension caused by a weight of the external heating belt 13 is negligible), and a tension is automatically exerted to the external heating belt 13 when the external heating belt 13 is pressed against the fixing roller 11.

Further, the ideal peripheral length L2 is an internal peripheral length which is set so that the external heating belt 13 does not loosen when the external heating belt 13 is pressed against the fixing roller 11 with a predetermined load. Note that, the predetermined load is set in advance in consideration for (i) a temperature at which the external heating belt 13 is heated, (ii) a temperature at which the fixing roller 11 is heated (target temperature), (iii) a heat transfer coefficient between the external heating belt 13 and the fixing roller 11, (iv) and the like so that the external heating belt 13 and the fixing roller 11 can be brought into contact with each other at a contact area (heating nip width) which allows the fixing roller 11 to be appropriately heated. Note that, in the present embodiment, the internal peripheral length Lb of the external heating belt 13 is set so that a suitable tension for causing the fixing roller 11 to rotate the external heating belt 13 acts upon the external heating belt 13 when the external heating belt 13 is pressed against the fixing roller 11 with the predetermined load.

Note that, as illustrated in FIG. 4(*b*), the ideal peripheral length L2 is represented as follows.

$$L2=\pi\times Dh+Lp+(Dh+Df)\times\theta/2$$

in case where the heating rollers 14*a* and 14*b* are pressed against the fixing roller 11 via the external heating belt 13. Note that, $\theta=2\times\arcsin(Lp/(Dh+Df))$ and Df represents an external diameter of the fixing roller 11.

In case where the internal peripheral length Lb of the external heating belt 13 is larger than the ideal peripheral length L2, the external heating belt 13 loosens even though the heating rollers 14*a* and 14*b* are pressed against the fixing roller 11 via the external heating belt 13. Thus, the external heating belt 13 is not suitably rotated by the fixing roller 11. Further, the external heating belt 13 and the fixing roller 11 are not stably in contact with each other at a heating nip area, so that it is impossible to sufficiently heat the fixing roller 11.

Thus, it is preferable that the internal peripheral length Lb of the external heating belt 13 satisfies the following relation.

$$Lb\leqq L2 \quad (2)$$

However, as apparent from the below-described test results, it is not necessary to satisfy the foregoing expression (2) as long as the following expression holds.

$$L2\times0.0095\leqq Lb\leqq L2\times1.0246 \quad (2)'$$

Under this condition, it is possible to prevent the external heating belt 13 from being inappropriately rotated and it is possible to prevent insufficient heating of the fixing roller 11.

Thus, it is preferable that the internal peripheral length Lb of the external heating belt 13 satisfies the following relation.

$$L1\leqq Lb\leqq L2\leqq1.0246 \quad (3)$$

Note that, in case where it is necessary to consider the influence caused by thermal expansion of the external heating belt 13, it is preferable that either of the following relations is satisfied.

$$L2-L1\geqq\gamma\times(t-20)\times Lb \quad (4)$$

$$L1\leqq(1+\gamma\times(t-20))\times Lb\leqq L2\times1.0246 \quad (4)'$$

where γ represents a linear expansion coefficient of the external heating belt 13, and t represents a temperature (° C.) at which the external heating belt 13 is used.

As long as Lb, L1, and L2 are in the relation represented by the foregoing expression (4) or (4)', even if the external heating belt 13 thermally expands due to the heating, it is possible to surely exert a tension to the external heating belt 13 by pressure of the fixing roller 11. Further, the external heating belt 13 can be appropriately rotated by the fixing roller 11. Further, it is possible to appropriately heat the fixing roller 11.

Figure 5A:
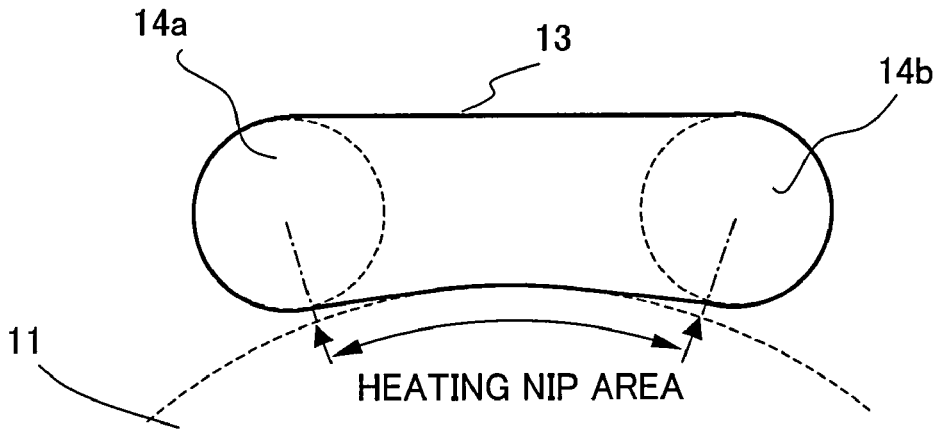
FIG. 5(*a*) to FIG. 5(*c*) are explanatory drawings each of which illustrates a relation between an internal peripheral length Lb' of the external heat belt under a heating condition and an ideal periphery length L2 of the external heat belt under such condition that the fixing roller is pressed against the external heat belt.
Figure 5B:
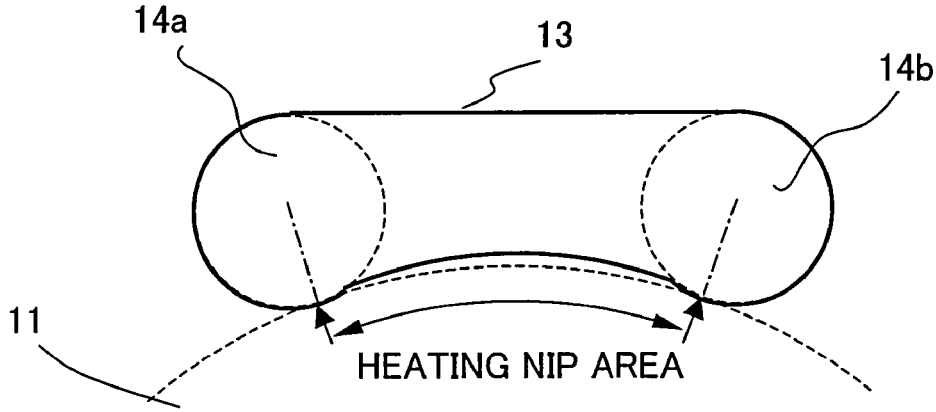
Figure 5C:
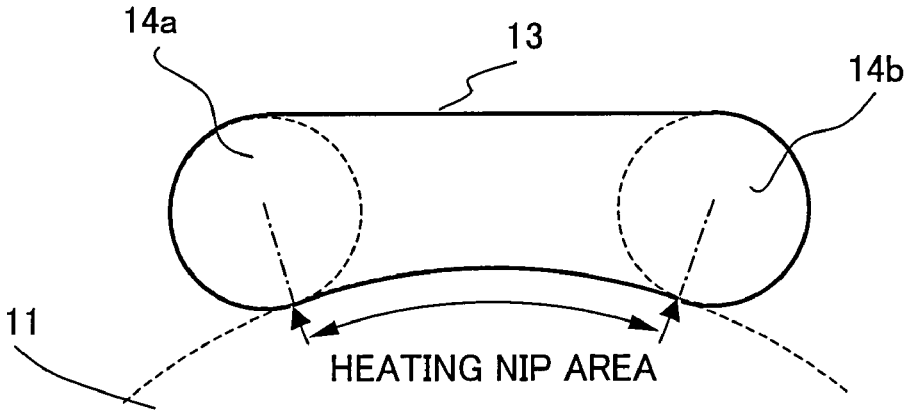

Next, the following description will further detail the relation between (i) Lb'={1+γ×(t−20)}×Lb (Lb' is the internal peripheral length of the external heating belt 13 in being heated) and (ii) the ideal peripheral length L2. FIG. 5(*a*) illustrates a condition under which the fixing roller 11 and the external heating belt 13 are in contact with each other in case where Lb'<<L2. FIG. 5(*b*) illustrates a condition under which the fixing roller 11 and the external heating belt 13 are in contact with each other in case where Lb'>>L2. FIG. 5(*c*) illustrates a condition under which the fixing roller 11 and the external heating belt 13 are in contact with each other in case where Lb' is substantially equal with L2.

(i) In Case Where Lb'<<L2

As illustrated in FIG. 5(*a*), the external heating belt 13 and the fixing roller 11 are not in contact with each other at both ends of the heating nip area (heating nip section 19). That is, a predetermined pressure (40N in the present embodiment) for pressing the external heating belt 13 against the fixing roller 11 does not allow the external heating roller 13 and the fixing roller 11 to be in contact with each other at an entire part of the heating nip area (predetermined nip width (20 mm in the present embodiment)). Thus, the fixing roller 11 is less heated by the external heating belt 13. Further, excessively high tension is exerted to the external heating belt 13, so that rotational loads of the heating rollers 14*a* and 14*b* increase. As a result, the external heating belt 13 is not rotated by the fixing roller 11, so that the fixing roller 11 slips.

(ii) In Case Where Lb'>>L2

As illustrated in FIG. 5(*b*), the external heating belt 13 loosens, so that the external heating belt 13 and the fixing roller 11 are unstably in contact with each other at the heating nip area. Thus, the fixing roller 11 is less heated by the external heating belt 13. Further, no tension is exerted to the external heating belt 13, and a frictional force between the external heating belt 13 and the heating rollers 14*a* and 14*b* decreases. Thus, the heating rollers 14*a* and 14*b* are not rotated by the external heating belt 13 and both the rollers slip.

(iii) In Case where Lb' is Substantially Equal with L2

As illustrated in FIG. 5(*c*), the external heating belt 13 is in contact with the fixing roller 11 at an entire part of the heating nip area. Thus, it is possible to allow the external heating belt 13 to keep its heating performance with respect to the fixing roller 11. Further, also the tension exerted to the external heating belt 13 is appropriate, so that the external heating roller 13 can be appropriately rotated by the fixing roller 11, and the heating rollers 14*a* and 14*b* can be appropriately rotated by the external heating belt 13.

A test was carried out in order to study an optimal relation between (i) the internal peripheral length Lb' of the external heating belt 13 in being heated and (ii) the ideal peripheral length L2 of the external heating belt 13 in being pressed against the fixing roller 11. The following description explains a result of the test.

(Test 1)

A surface of a polyimide base material (product of UBE INDUSTRIES, LTD., product name: Upilex S) was coated with a fluorocarbon resin obtained by blending PETE and PFA with each other as a releasing layer whose thickness was 20 μm. In this manner, a plurality of external heating belts 13 which are different from each other in a peripheral length were produced. As illustrated in FIG. 1, each of the external heating belts 13 was suspended by the two heating rollers 14*a* and 14*b* whose center distance was fixed, and the external heating belt 13 was pressed against the fixing roller 11 with a load of 40N.

Note that, the heating rollers 14*a* and 14*b* were produced as follows. A surface of an aluminum core bar whose thickness was 0.75 mm was coated with a fluorocarbon resin obtained by blending PTFE and PFA so as to have a thickness of 20 μm. Further, the fixing roller 11 was produced as follows. An aluminum core bar was coated with a silicon rubber layer whose thickness was 2 mm, and thus formed silicon rubber layer was coated with a PFA tube whose thickness was 30 μm. Further, as the heater lamps 15*a* and 15*b*, heater lamps each of which has a rated apparent power of 300 W were used.

Further, the fixing roller 11 was rotated at a speed of 355 mm/s for a single rotation while heating the external heating belt 13 at 220° C., and it was checked whether or not the external heating belt 13 and the heating rollers 14*a* and 14*b* were rotated. At the same time, the heating performance of the external heating belt 13 was checked by measuring a speed at which a surface temperature of the fixing roller 11 rises. Results of the test are shown in Table 1 and Table 2.

TABLE 1

| Belt length Lb | Belt length Lb' | L1 | L2 | (Lb' − L2)/L2 | Heating performance | Belt driving | Roller driving |
|---|---|---|---|---|---|---|---|
| 95.88 mm | 96.22 mm | 95.86 mm | 96.34 mm | −0.12% | x | x | x |
| 96.35 mm | 96.70 mm | ↑ | ↑ | 0.37% | ○ | ○ | ○ |
| 96.82 mm | 97.17 mm | ↑ | ↑ | 0.86% | ○ | ○ | ○ |
| 97.39 mm | 97.74 mm | ↑ | ↑ | 1.45% | ○ | ○ | ○ |
| 97.86 mm | 98.21 mm | ↑ | ↑ | 1.94% | ○ | ○ | ○ |

TABLE 1-continued

| Belt length Lb | Belt length Lb' | L1 | L2 | (Lb' − L2)/L2 | Heating performance | Belt driving | Roller driving |
|---|---|---|---|---|---|---|---|
| 98.33 mm | 98.68 mm | ↑ | ↑ | 2.43% | ○ | ○ | ○ |
| 98.80 mm | 99.16 mm | ↑ | ↑ | 2.92% | x | ○ | x |

TABLE 2

| Belt length Lb | Belt length Lb' | L1 | L2 | (Lb' − L2)/L2 | Heating performance | Belt driving | Roller driving |
|---|---|---|---|---|---|---|---|
| 123.62 mm | 124.06 mm | 123.59 mm | 125.54 mm | −1.18% | x | x | x |
| 124.25 mm | 124.69 mm | ↑ | ↑ | −0.68% | Δ | Δ | Δ |
| 125.03 mm | 125.48 mm | ↑ | ↑ | −0.05% | ○ | ○ | ○ |
| 125.66 mm | 126.11 mm | ↑ | ↑ | 0.45% | ○ | ○ | ○ |
| 126.92 mm | 127.37 mm | ↑ | ↑ | 1.46% | ○ | ○ | ○ |
| 128.17 mm | 128.63 mm | ↑ | ↑ | 2.46% | ○ | ○ | ○ |
| 129.43 mm | 129.90 mm | ↑ | ↑ | 3.47% | x | ○ | x |

Table 1 shows results of the test carried out by using seven external heating belts 13, which were different from one another in a peripheral length within a range from 95.88 mm to 98.80 mm under such condition that an external diameter of the fixing roller 11 was 50 mm, an external diameter of each of the heating rollers 14*a* and 14*b* was 16 mm, a center distance between the heating rollers 14*a* and 14*b* was 22.8 mm.

Further, Table 2 shows results of the experiment carried out by using seven external heating belts 13, which were different from one another in a peripheral length within a range from 123.62 mm to 129.43 mm under such condition that an external diameter of the fixing roller 11 was 60 mm, an external diameter of each of the heating rollers 14*a* and 14*b* was 14.8 mm, a center distance between the heating rollers 14*a* and 14*b* was 38.55 mm.

Note that, the heating performances are evaluated in Table 1 and Table 2 as follows. A condition under which the temperature rising speed was highest and a condition under which 90% or higher of the temperature rising speed was obtained are indicated by the sign ○, a condition under which 80 to 90% of the temperature rising speed was obtained is indicated by the sign Δ, and a condition under which 80% or less of the temperature rising speed was obtained is indicated by the sign x.

Further, a driving performance (belt driving) of the external heating belt 13 and a driving performance (roller driving) of the heating rollers 14*a* and 14*b* are evaluated as follows. A roller appropriately rotated is indicated by the sign o, and a roller which slipped and was unstably rotated is indicated by the sign Δ, and a roller which slipped and did not rotate at all is indicated by the sign x.

The results in Table 1 and Table 2 are as follows. As long as $-0.0005 \leqq (Lb'-L2)/L2 \leqq 0.0246$, that is, $-0.0005 \leqq ((1+\gamma\times(t-t_0))\times Lb_0-L2)/L2 \leqq 0.0246$ where $Lb_0$ represents an internal peripheral length of the external heating belt 13 at a room temperature $t_0$, it is possible to favorably set the tension of the external heating belt 13. That is, it is possible to prevent the following problems: Excessively high tension of the external heating belt 13 causes the external heating belt 13 to slip and causes the heating performance to drop; and excessively low tension of the external heating belt 13 causes the heating rollers 14*a* and 14*b* to slip and causes the heating performance to drop.

(Test 2)

Next, the following description will explain results of Comparative Test carried out in terms of the belt snaking prevention function and the heating performance by comparing (i) the fixing apparatus 1 (present example) according to the present embodiment, (ii) an arrangement (Comparative Test 1) in which the center distance between the heating rollers 14*a* and 14*b* is variable, and (iii) an arrangement (Comparative Test 2) in which, in addition to the heating rollers 14*a* and 14*b*, a tension roller for exerting a tension to the external heating belt 13 is provided.

Note that, for convenience in description, the same reference signs are given to members having the same functions as the members, out of the members used in Comparative Example 1 and Comparative Example 2, which are provided also in the present example, and descriptions thereof are omitted.

In the present example, the arrangement in which the external heating belt 13 which had been used in Test 1 and whose peripheral length was 97.39 mm was used.

Figure 6A:
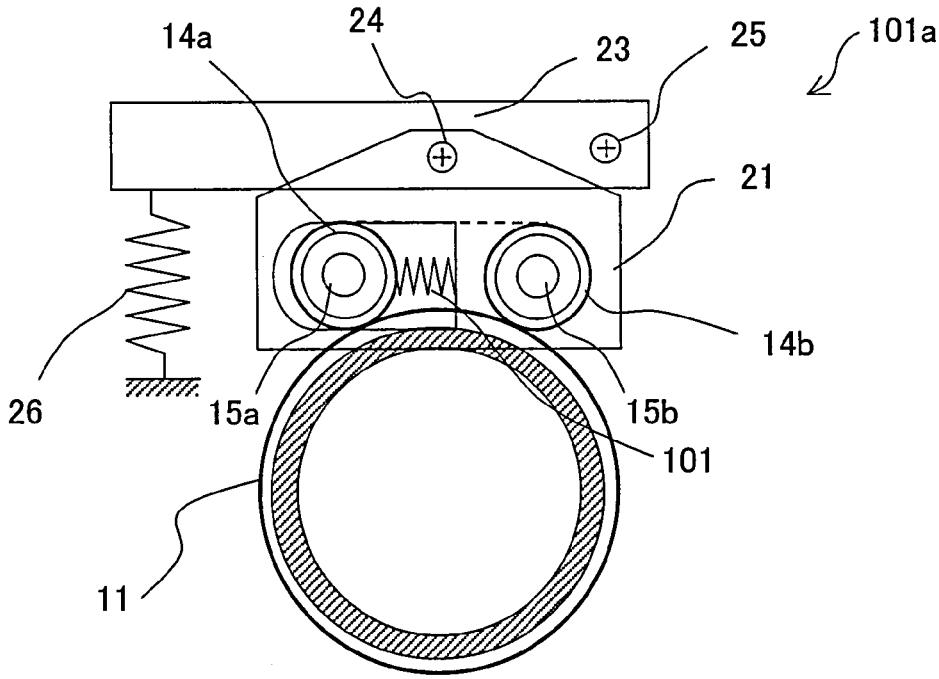
FIG. 6(*a*) and FIG. 6(*b*) are explanatory drawings each of which illustrates a structure of an external heat belt unit according to Comparative Example.
Figure 6B:
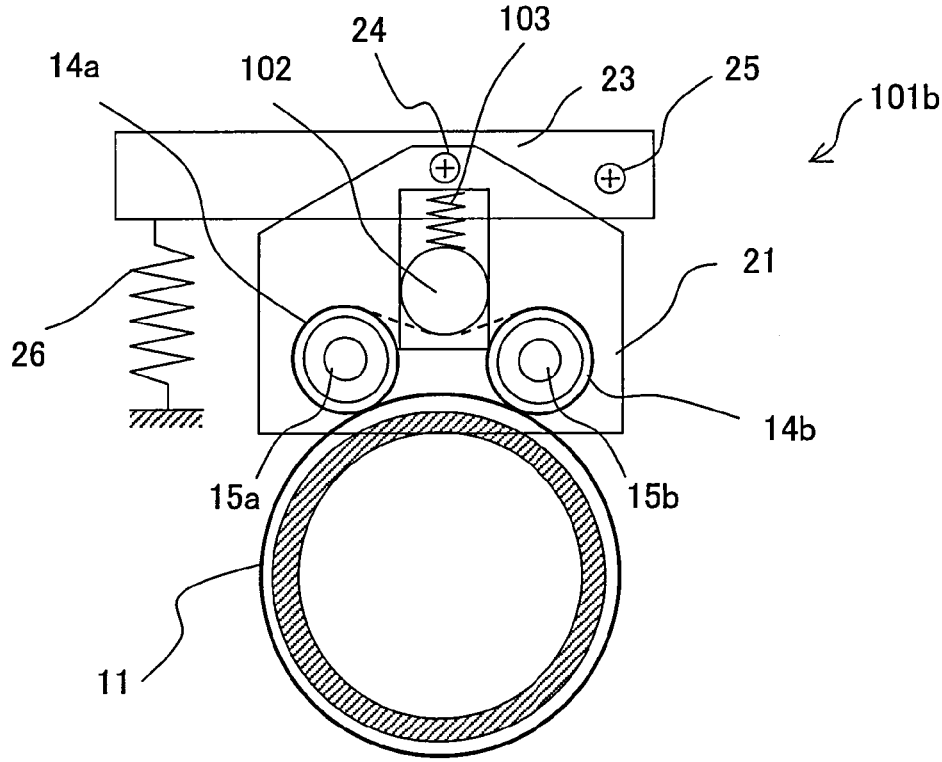

FIG. 6(*a*) is a cross sectional view schematically illustrating an external heating belt unit 101*a* according to Comparative Example 1. As illustrated in FIG. 6(*a*), the external heating belt unit 101*a* is arranged so that the heating roller 14*a* is movable in a horizontal direction (in a direction opposite to the heating roller 14*a*). A predetermined load (40N in this case) is exerted by the tension exerting coil spring 101 with respect to a bearing (not shown here) of the heating roller 14*a*, so that a tension is exerted to the external heating belt 13.

FIG. 6(*b*) is a cross sectional view schematically illustrating a structure of an external heating belt unit 101*b* according to Comparative Example 2. As illustrated in FIG. 6(*b*), the external heating belt unit 101*b* includes: a tension roller 102 for exerting a tension to the external heating belt 13; and a tension exerting coil spring 103 for pushing the tension roller 102 into a direction in which the tension is exerted to the external heating belt 13. The tension roller 102 is made of stainless material whose diameter is 12 mm and is provided so as to be in contact with an external face of the external heating belt 13. As a result, a pushing force of the tension exerting coil spring 103 allows a predetermined load (40N in this case) to be exerted to the external heating belt 13 via the tension roller 102, so that the tension is exerted to the external heating belt 13. Note that, in Comparative Example 2, the center distance between the heating rollers 14*a* and 14*b* is fixed as in the present example.

Other arrangement of each Comparative Example is the same as in the present example.

Next, a test method and an evaluation method will be described.

First, the belt snaking prevention function was tested as follows. First, a speed at which the external heating belt 13 moves in a snaking direction (a direction in which the external heating belt 13 is orthogonal to a rotational direction) (the speed is referred to as "deviation speed" was measured. Specifically, the external heating belt 13 was rotated at a predetermined time (one minute in this case) and a quantity of deviation from an initial position into a snaking direction was measured, and the quantity of deviation was divided by a rotational time, thereby calculating the deviation speed. Note that, it is known that: the belt deviation speed and the belt deviation force are correlated with each other, and the deviation force is greater as the deviation speed is higher.

Second, a durability test was carried out with respect to the external heating belt 13 with it aged. The test was carried out as follows. In an intermittent mode in which a rotation period of 43 seconds and a cessation period of 30 seconds were alternately repeated, idling aging was carried out, and whether or not a belt end (a side portion of the external heating belt 13) whose deviation was restricted by the deviation preventing members 27*a* and 27*b* had any breakage was evaluated.

Further, the thermal efficiency was tested as follows. First, the external heating belt 13 was heated from a room temperature, and time taken to complete warm-up of the external heating belt 13 (time taken for a temperature of the external heating belt 13 to rise to 220° C.) (the time is referred to as "warm-up time") was measured.

Second, heat loss of the external heating belt 13 during the operation was measured. Specifically, temperatures of the external heating belt 13 and the fixing roller 11 were controlled at 220° C. in a rotation state, and average power consumption of the heater lamps 15*a* and 15*b* was measured.

Results of the experiments are shown in Table 3.

TABLE 3

| | Deviation speed | Belt end breakage | Warm-up time | Heat loss |
|---|---|---|---|---|
| Present Example | 2 mm/min | No breakage occurred in 200 h | 150 seconds | 32 W |
| Comparative Example 1 | 12 mm/min | Breakage occurred in 30 h | 150 seconds | 32 W |
| Comparative Example 2 | 5 mm/min | Breakage occurred in 160 h | 200 seconds | 48 W |

As shown in Table 3, the belt deviation speed was the lowest in the present example and was the highest in Comparative Example 1. Thus, the deviation force exerted to the external heating belt 13 is supposed to be the smallest in the present example.

The deviation speed of Comparative Example 1 was the highest for the following reason: the tension is exerted to the external heating belt 13 by externally pushing the heating roller 14*a*, so that it is impossible to secure the parallelism between the heating rollers 14*a* and 14*b*. Further, in Comparative Example 2, the parallelism between the heating rollers 14*a* and 14*b* is the same as in the present example, but it is impossible to secure the parallelism between (i) the heating rollers 14*a* and 14*b* and (ii) the tension roller 102, so that the deviation speed is higher than in the present example.

As a result of the durability test, breakage occurred in the belt end at an earliest timing in Comparative example 1 (30 hours later), and breakage occurred 160 hours later in Comparative Example 2, and no breakage occurred even 200 hours later in the present example. These results substantially correspond to results of the test concerning the belt deviation speed.

As to the warm-up time indicative of the thermal efficiency, the present example and Comparative Example 1 were identical with each other (150 seconds). However, in Comparative Example 2, the warm-up time was longer than the warm-up time of each of the present example and Comparative Example 1 by 50 seconds (that is, the warm-up time was 200 seconds). Further, as to the heat loss, average power consumption of the heater lamps 15*a* and 15*b* was 32 W in the present example and Comparative Example 1. However, in Comparative Example 2, the average power consumption was 1.5 times as great as that of the present example and Comparative Example 1 (that is, the average power consumption was 48 W). These results show that: the tension roller 102 is a heat load, which causes heat loss of the tension roller, so that the thermal efficiency drops.

As apparent from the results of the test, according to the present example, it is possible to improve the durability of the belt due to smaller belt deviation force compared with a conventional arrangement in which the center distance between the belt suspending rollers is variable or an arrangement (Comparative Example 2) in which not only the belt suspending rollers but also a tension roller for exerting a tension to the external heating belt is provided. Further, it is possible to improve the thermal efficiency at which the fixing roller 11 is heated.

As described above, the fixing apparatus according to the present embodiment is arranged so that a center distance between the heating rollers 14*a* and 14*b* for suspending the external heating belt 13 is fixed, and a peripheral length of the external heating belt 13 is set so that a tension is not exerted to the external heating belt 13 when the external heating belt 13 is not pressed against the fixing roller 11 and the tension is exerted to the external heating belt 13 when the external heating belt 13 is pressed against the fixing roller 11.

Thus, the center distance between the heating rollers 14*a* and 14*b* for suspending the external heating belt 13 is fixed, so that it is possible to keep high parallelism between the heating rollers 14*a* and 14*b*, thereby suppressing snaking (reducing the deviation force) of the external heating belt 13. That is, (i) the parallelism between the heating rollers 14*a* and 14*b* and (ii) the deviation force exerted to the external heating belt 13 are correlated with each other. As the common difference in the parallelism is greater (as the parallelism is lower), the deviation force is greater. As the parallelism is higher, the deviation force is smaller. In the present embodiment, as described above, it is possible to suppress the common difference in the parallelism between the heating rollers 14*a* and 14*b* to 100 μm or less, thereby reducing the deviation force exerted to the external heating belt 13 compared with the conventional arrangement. As a result, it is possible to surely prevent the external heating belt 13 from snaking with the aforementioned simple arrangement. Further, it is not necessary to excessively secure the strength (thickness) of the external heating belt 13 to prevent the snaking (the external heating belt 13 can be made thin), so that it is possible to improve the heating performance (heat conducting performance) of the external heating belt 13.

Further, when the external heating belt 13 is not pressed against the fixing roller 11 (for example, when the external heating belt unit 30 has not been installed to the fixing apparatus 1 or when the external heating belt unit 30 is detached from the fixing apparatus 1), the peripheral length of the external heating belt 13 is set so that a tension is not exerted to the external heating belt 13, so that it is possible to simplify the arrangement of the external heating belt unit 30, thereby facilitating fabrication thereof. That is, if it is so arranged that the tension is exerted to the external heating belt 13 when the external heating belt unit 30 is separated from any other device (when the external heating belt 13 is pressed against the fixing roller 11), the workability such as installation (suspension) of the external heating belt 13 with respect to the heating rollers 14*a* and 14*b* drops, but it is possible to improve the workability such as installation of the external heating belt 13 by preventing any tension from being exerted when the external heating belt 13 is not pressed against the fixing roller 11.

Further, the peripheral length of the external heating belt 13 is set so that the tension is exerted to the external heating belt 13 when the external heating belt 13 is pressed against the fixing roller 11. Thus, it is not necessary to additionally provide a tension roller, so that it is possible to simplify the arrangement of the external heating belt unit 30. Further, it is possible to reduce the thermal load and to improve the thermal efficiency compared with the case where the tension roller is provided.

Further, the center distance between the heating rollers 14*a* and 14*b* is fixed, so that due to the thermal expansion of the external heating belt 13, the tension of the external heating belt 13 in a high temperature state (heating state) is lower than in a low temperature state (room temperature state). Thus, it is possible to prevent slip between (i) the external heating belt 13 and (ii) the heating rollers 14*a* and 14*b* at the time of warm-up, and it is possible to prevent abrasion or breakage of the external heating belt 13 which is caused by the snaking in the heating state.

This will be further detailed as follows. For example, in case of using a sliding bearing made of heat-resistant resin as the bearing 22*a* of the heating roller 14*a* and the bearing 22*b* of the heating roller 14*b*, a friction coefficient between (i) the bearings 22*a* and 22*b* and (ii) the heating rollers 14*a* and 14*b* in the room temperature before completing the warm-up of the fixing apparatus 1 is higher than in case of using a ball bearing or the like. Thus, when the tension of the external heating belt 13 is low, the heating rollers 14*a* and 14*b* arranged so as to be rotated by the external heating belt 13 are likely to slip. Thus, it is preferable that the tension of the external heating belt 13 is relatively high in the room temperature state. While, in the heating state, there is a problem in the durability of the side portion of the external heating belt 13 which problem is caused by the snaking of the external heating belt 13, so that it is preferable that the tension of the external heating belt 13 is low and the deviation force exerted to the external heating belt 13 is small. Thus, the center distance between the heating rollers 14*a* and 14*b* is fixed, so that the tension of the external heating belt 13 in the heating state (high temperature state) is lower than in the room temperature state. As a result, it is possible to automatically realize an ideal tension condition.

Note that, the present embodiment described the arrangement in which the two heating rollers (external heating belt suspending rollers) 14*a* and 14*b* are provided, but the present invention is not limited to this. It may be so arranged that more heating rollers are further provided (for example, three heating rollers may be provided, or four heating rollers may be provided).

Further, the present embodiment described the arrangement in which the external diameter of the heating roller 14*a* and the external diameter of the heating roller 14*b* are identical to each other, but the present invention is not limited to this. These external diameters of the heating rollers may be different from each other.

Further, the present embodiment described the arrangement in which both the heating rollers 14*a* and 14*b* are pressed against the fixing roller 11 via the external heating belt 13, but the present invention is not limited to this. For example, it may be so arranged that none of the heating rollers are pressed against the fixing roller 11 and only the external heating roller 13 is in contact with the fixing roller 11. That is, it may be so arranged that the external heating belt 13 is not pressed against the fixing roller 11 at a contact area between the heating rollers and the external heating belt 13. Further, it may be so arranged that three or more heating rollers are brought into contact with the fixing roller 11 via the external heating belt 13.

Further, the present embodiment described the case where the present invention is applied to a color image forming apparatus, but the present invention is not limited to this. The present invention is applicable also to an image forming apparatus for forming a monochrome image.

In order to solve the foregoing problem, a fixing apparatus of the present invention includes: a fixing member; an endless belt; a plurality of suspending rollers for suspending the endless belt; and heating means for heating the endless belt, the endless belt being pressed against the fixing member so as to heat the fixing member, wherein the suspending rollers are provided in parallel so that a center distance therebetween is fixed, and the endless belt is pressed against the fixing member so as to be rotated by the fixing member, and an internal peripheral length of the endless belt is set so that a tension is not exerted to the endless belt when the endless belt is not pressed against the fixing member and the tension is exerted to the endless belt when the endless belt is pressed against the fixing member. Note that, the internal peripheral length which does not cause the tension to be exerted to the endless belt is theoretically a length which does not cause the tension to be exerted to the endless belt when influence of a weight of the endless belt is not taken into consideration.

According to the arrangement, the suspending rollers are provided in parallel so that the center distance therebetween is fixed, so that it is possible to secure the parallelism between the belt suspending rollers even when the endless belt is rotated by the fixing member. Thus, it is possible to reduce the deviation force exerted to the endless belt, thereby preventing snaking of the endless belt.

Further, the internal peripheral length of the endless belt is set so that the tension is not exerted to the endless belt when the endless belt is not pressed against the fixing member. Thus, the tension is not exerted to the endless belt when the endless belt is not pressed against the fixing member, so that it is possible to improve the workability such as suspension of the endless belt with respect to the suspending rollers.

Further, the internal peripheral length of the endless belt is set so that the tension is exerted to the endless belt when the endless belt is pressed against the fixing member, so that it is not necessary to additionally provide a member (tension roller or the like) for exerting the tension to the endless belt, thereby simplifying the arrangement of the fixing apparatus. Further, it is possible to reduce the thermal load and to improve the thermal efficiency compared with the case where the tension roller or the like is provided.

Further, the center distance between the suspending rollers is fixed, so that the tension exerted to the endless belt is lower in a high temperature state (heating state) than a low temperature state (room temperature state) due to thermal expansion of the endless belt. Thus, it is possible to prevent slip between the endless belt and the suspending rollers at the time of warm-up of the fixing apparatus, and it is possible to prevent abrasion or breakage of the endless belt which is caused by snaking of the endless belt in the heating state.

Further, the fixing apparatus may be arranged so that the internal peripheral length of the endless belt is set so that a tension causing the endless belt to be rotated by the fixing member is exerted to the endless belt when the endless belt and the fixing member are pressed against each other so as to have a contact area therebetween which allows the fixing member to be heated.

According to the arrangement, when the endless belt and the fixing member are brought into contact with each other so as to have a contact area (heat transfer area) therebetween which allows the fixing member to be heated, a tension which causes the endless belt to be rotated by the fixing member is exerted to the endless belt. Thus, by pressing the endless belt against the fixing member, it is possible to appropriately heat the fixing member and it is possible to appropriately allow the endless belt to be rotated.

Further, the fixing apparatus may be arranged so that at least two suspending rollers of the plurality of suspending rollers are in contact with the fixing member through contact with the endless belt so that the endless belt is pressed against the fixing member, and the internal peripheral length of the endless belt is set so that a contact area of the endless belt is entirely in contact with the fixing member, said contact area allowing said at least two suspending rollers and said fixing member to be in contact with each other and extending from an uppermost stream side contact portion to a lowermost stream side contact portion in a rotational direction of the endless belt.

According to the arrangement, in pressing the endless belt against the fixing member, a contact area of the endless belt is entirely in contact with the fixing member, said contact area allowing said at least two suspending rollers and said fixing member to be in contact with each other and extending from an uppermost stream side contact portion to a lowermost stream side contact portion in a rotational direction of the endless belt. Thus, the center distance between said at least two suspending rollers is set so that the contact area between the endless belt and the fixing member in pressing the endless belt against the fixing member allows the fixing member to be appropriately heated, thereby appropriately heating the fixing member.

Further, the fixing apparatus may be arranged so that $L1 \leqq Lb \leqq L2 \times 1.0246$ is satisfied where Lb represents the internal peripheral length of the endless belt, L1 represents a theoretical internal peripheral length for preventing sag of the endless belt when the endless belt is not pressed against the fixing member, and L2 represents a theoretical internal peripheral length for preventing sag of the endless belt when the endless belt is pressed against the fixing member so as to have a contact area therebetween which allows the fixing member to be appropriately heated.

According to the arrangement, the tension is not exerted to the endless belt when the endless belt is not pressed against the fixing member, and the tension is exerted to the endless belt without fail when the endless belt is brought into contact with the fixing member. Further, it is possible to appropriately heat the fixing member and it is possible to allow the endless belt to be appropriately rotated by the fixing member.

Further, the fixing apparatus may be arranged so that $L2 - L1 \geqq \gamma \times (t - t_0) \times Lb_0$ is satisfied where $Lb_0$ represents an internal peripheral length of the endless belt at a room temperature $t_0$, $\gamma$ represents a linear expansion coefficient of the endless belt, and t represents a temperature at which the endless belt is used.

Alternatively, the fixing apparatus may be arranged so that $L1 \leqq (1+\gamma \times (t - t_0)) \times Lb_0 \leqq L2 \times 1.0246$ is satisfied where $Lb_0$ represents an internal peripheral length of the endless belt at a room temperature $t_0$, $\gamma$ represents a linear expansion coefficient of the endless belt, and t represents a temperature at which the endless belt is used.

According to the arrangement, even if the endless belt thermally expands upon being heated, it is possible to exert the tension to the endless belt without fail by pressing the endless belt against the fixing member. Further, it is possible to appropriately heat the fixing member and it is possible to allow the endless belt to be appropriately rotated by the fixing member.

Further, the fixing apparatus may be arranged so that $-0.0005 \leqq ((1+\gamma \times (t - t_0)) \times Lb_0 - L2)/L2 \leqq 0.0246$.

In the case where $-0.0005 > ((1+\gamma \times (t - t_0)) - Lb_0 - L2)/L2$, the tension exerted to the endless belt is too high, which results in greater rotational load of the suspending rollers. Thus, the endless belt slips or a similar problem occurs, so that it may be impossible to allow the endless belt to be appropriately rotated by the fixing member. Further, the contact area between the endless belt and the fixing member reduces, so that the fixing member cannot be appropriately heated. As a result, the thermal efficiency may drop.

While, in the case where $((1+\gamma \times (t - t_0)) \times Lb_0 - L2)/L2 > 0.0246$, the endless belt and the fixing member are unstably in contact with each other, so that the fixing member cannot be appropriately heated. As a result, the thermal efficiency may drop. Further, the endless belt and the fixing member are unstably in contact with each other, so that a frictional force between the fixing member and the endless belt drops. As a result, it may be impossible to allow the endless belt to be appropriately rotated by the fixing member. Further, in case of the arrangement in which each suspending roller is rotated by the endless belt, the tension exerted to the endless belt is insufficient, so that the frictional force between the endless belt and each suspending roller drops. As a result, the suspending roller may slip without being rotated by the endless belt.

In contrast, by satisfying $-0.0005 \leqq ((1+\gamma \times (t - t_0)) \times Lb_0 - L2)/L2 \leqq 0.0246$ as arranged in the foregoing manner, it is possible to prevent excessively high tension of the endless belt from causing the endless belt to be insufficiently rotated by the fixing member, and it is possible to prevent the heating performance from dropping. Further, it is possible to prevent excessively low tension of the endless belt from causing the endless belt to be insufficiently rotated by the fixing member, and it is possible to prevent the heating performance from dropping. Alternatively, it is possible to prevent each suspending roller from being insufficiently rotated by the endless belt.

An image forming apparatus of the present invention includes: image forming means for forming a toner image on a recording material; and the aforementioned fixing apparatus. Thus, the image forming apparatus of the present invention exhibits the same effects as the aforementioned fixing apparatus.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. A fixing apparatus, comprising: a fixing member; an endless belt; two suspending rollers for suspending the endless belt; heating means for heating the endless belt; and a pressure member pressed against the fixing member, the endless belt being pressed against the fixing member so as to heat the fixing member, an unfixed toner image on a recording material passing through a pressing part of the fixing member and the pressure member so as to be fixed on the recording material, wherein the suspending rollers are provided in parallel so that a center distance therebetween is fixed, and are pressed against the fixing member via the endless belt, and the endless belt is pressed against the fixing member so as to be rotated by the fixing member, and $\pi \times Dh + 2 \times Lp \leqq Lb$ is satisfied where Lb represents an internal peripheral length of the endless belt obtained in a state in which the endless belt is not suspended by the two suspending rollers, Dh represents an external diameter of each of the two suspending rollers, and Lp represents a center distance between the two suspending rollers, and the internal peripheral length Lb of the endless belt is set so that, in a case where the endless belt is pressed against the fixing member, the endless belt is in contact with the fixing member in an entire area of a pressing part in which the two suspending rollers are pressed against the fixing member via the endless belt, and the endless belt is therefore rotated by the fixing member without providing a tension exerting member for exerting a tension to the endless belt and without causing a slip between the two suspending rollers and the endless belt.

2. The fixing apparatus as set forth in claim 1, wherein the internal peripheral length of the endless belt is set so that a tension causing the endless belt to be rotated by the fixing member is exerted to the endless belt when the endless belt and the fixing member are pressed against each other so as to have a contact area therebetween which allows the fixing member to be heated.

3. The fixing apparatus as set forth in claim 1, wherein at least two suspending rollers of the plurality of suspending rollers are in contact with the fixing member through contact with the endless belt so that the endless belt is pressed against the fixing member, and the internal peripheral length of the endless belt is set so that a contact area of the endless belt is entirely in contact with the fixing member, said contact area allowing said at least two suspending rollers and said fixing member to be in contact with each other and extending from an uppermost stream side contact portion to a lowermost stream side contact portion in a rotational direction of the endless belt.

4. The fixing apparatus as set forth in claim 1, wherein $L1 \leqq Lb \leqq L2 \times 1.0246$ is satisfied where Lb represents the internal peripheral length of the endless belt, L1 represents a theoretical internal peripheral length for preventing sag of the endless belt when the endless belt is not pressed against the fixing member, and L2 represents a theoretical internal peripheral length for preventing sag of the endless belt when the endless belt is pressed against the fixing member so as to have a contact area therebetween which allows the fixing member to be appropriately heated.

5. The fixing apparatus as set forth in claim 4, wherein $L2 - L1 \geqq \gamma \times (t - t_0) \times Lb_0$ is satisfied where $Lb_0$ represents an internal peripheral length of the endless belt, at a room temperature $t_0$, $\gamma$ represents a linear expansion coefficient of the endless belt, and t represents a temperature at which the endless belt is used.

6. The fixing apparatus as set forth in claim 4, wherein $L1 \leqq (1 + \gamma \times (t - t_0)) \times Lb_0 \leqq L2 \times 1.0246$ is satisfied where $Lb_0$ represents an internal peripheral length of the endless belt at a room temperature $t_0$, $\gamma$ represents a linear expansion coefficient of the endless belt, and t represents a temperature at which the endless belt is used.

7. The fixing apparatus as set forth in claim 5, wherein $-0.0005 \leqq ((1 + \gamma \times (t - t_0)) \times Lb_0 - L2)/L2 \leqq 0.0246.$

8. The fixing apparatus as set forth in claim 6, wherein $-0.0005 \leqq ((1 + \gamma \times (t - t_0)) \times Lb_0 - L2)/L2 \leqq 0.0246.$

9. An image forming apparatus, comprising: a fixing apparatus which includes a fixing member; an endless belt; two suspending rollers for suspending the endless belt; and heating means for heating the endless belt; and a pressure member pressed against the fixing member, the endless belt being pressed against the fixing member so as to heat the fixing member, an unfixed toner image on a recording material passing through a pressing part of the fixing member and the pressure member so as to be fixed on the recording material, wherein the suspending rollers are provided in parallel so that a center distance therebetween is fixed, and are pressed against the fixing member via the endless belt, and the endless belt is pressed against the fixing member so as to be rotated by the fixing member, and $\pi \times Dh + 2 \times Lp \leqq Lb$ is satisfied where Lb represents an internal peripheral length of the endless belt obtained in a state in which the endless belt is not suspended by the two suspending rollers, Dh represents an external diameter of each of the two suspending rollers, and Lp represents a center distance between the two suspending rollers, and the internal peripheral length Lb of the endless belt is set so that, in a case where the endless belt is pressed against the fixing member, the endless belt is in contact with the fixing member in an entire area of a pressing part in which the two suspending rollers are pressed against the fixing member via the endless belt, and the endless belt is therefore rotated by the fixing member without providing a tension exerting member for exerting a tension to the endless belt and without causing a slip between the two suspending rollers and the endless belt.

* * * * *